US010180086B2

(12) United States Patent
Kloeckener

(10) Patent No.: US 10,180,086 B2
(45) Date of Patent: Jan. 15, 2019

(54) HEAT EXCHANGING SYSTEM AND METHOD FOR A HEAT RECOVERY STEAM GENERATOR

(71) Applicant: NOOTER/ERIKSEN, INC., Fenton, MO (US)

(72) Inventor: Daniel B. Kloeckener, Kirkwood, MO (US)

(73) Assignee: NOOTER/ERIKSEN, INC., Fenton, MO (US)

( * ) Notice: Subject to any disclaimer, the term of this patent is extended or adjusted under 35 U.S.C. 154(b) by 286 days.

(21) Appl. No.: 15/025,186

(22) PCT Filed: Sep. 23, 2014

(86) PCT No.: PCT/US2014/057005
§ 371 (c)(1),
(2) Date: Mar. 25, 2016

(87) PCT Pub. No.: WO2015/048029
PCT Pub. Date: Apr. 2, 2015

(65) Prior Publication Data

US 2016/0245127 A1 Aug. 25, 2016

Related U.S. Application Data

(60) Provisional application No. 61/882,911, filed on Sep. 26, 2013.

(51) Int. Cl.
*F22B 37/02* (2006.01)
*F01K 23/10* (2006.01)
(Continued)

(52) U.S. Cl.
CPC ..... *F01K 23/101* (2013.01); *F22B 1/1815* (2013.01); *F22B 21/00* (2013.01);
(Continued)

(58) Field of Classification Search
CPC ..... F01K 23/101; F22D 1/16; F22B 1/1815
See application file for complete search history.

(56) References Cited

U.S. PATENT DOCUMENTS 4,214,450 A * 7/1980 Nagashima ..... F01K 23/106 60/39.182
4,552,099 A * 11/1985 Martens ..... F01K 23/108 122/406.4
(Continued)

FOREIGN PATENT DOCUMENTS

CN 102859277 A 1/2013
CN 103016157 A 4/2013
(Continued)

OTHER PUBLICATIONS

Supplemental European Search Report for corresponding European Patent Application 14849287.9 dated Jun. 9, 2017.
(Continued)

*Primary Examiner* — Nathaniel Herzfeld
(74) *Attorney, Agent, or Firm* — Sandberg Phoenix & von Gontard PC

(57) ABSTRACT

Heat recovery steam generator comprises a casing, low-pressure evaporator coils, preheater booster coils upstream thereof and feedwater heater coils downstream thereof, a water-to-water heat exchanger having low and high temperature paths; a first conduit from the preheater to the high-temperature path, and a second conduit from the feedwater heater to the preheater. A conduit can extend from feedwater heater to low-pressure evaporator. A conduit can extend from the water-to-water heat exchanger to the feedwater heater. High-pressure economizer coils can be upstream of the preheater, with a conduit exiting the feedwater heater to the high-pressure economizer. Additional coils can be upstream of the high-pressure economizer. The feedwater heater can comprise first and second sections, or
(Continued)

first, second and third sections; or more sections. The connections among the various components and sections can be near their upstream and downstream faces.

31 Claims, 5 Drawing Sheets

(51) Int. Cl.

| | |
|---|---|
| ***F22D 1/02*** | (2006.01) |
| ***F22B 1/18*** | (2006.01) |
| ***F22B 21/00*** | (2006.01) |
| ***F22D 1/16*** | (2006.01) |
| *F22D 1/00* | (2006.01) |
| *F01K 7/16* | (2006.01) |
| *F01K 13/00* | (2006.01) |

(52) U.S. Cl.
CPC ..... *F22B 37/025* (2013.01); *F22D 1/02* (2013.01); *F22D 1/16* (2013.01); *F01K 7/16* (2013.01); *F01K 13/006* (2013.01); *F01K 23/10* (2013.01); *F22D 1/00* (2013.01)

(56) References Cited

U.S. PATENT DOCUMENTS 4,932,204 A * 6/1990 Pavel ..... F01K 23/10 60/39.182
5,267,434 A * 12/1993 Termuehlen ..... F01K 23/10 122/7 R
6,508,206 B1 * 1/2003 Rechtman ..... F22B 37/025 122/1 C
2003/0131601 A1 * 7/2003 Baxter ..... F01K 23/105 60/772
2004/0011049 A1 * 1/2004 Schwarzott ..... B01F 3/0865 60/772
2010/0031625 A1 * 2/2010 Narayan ..... F01K 23/106 60/39.5
2012/0037097 A1 * 2/2012 Schroeder ..... F22D 1/003 122/1 C
2012/0255303 A1 10/2012 Labbe
2014/0260285 A1 * 9/2014 Rechtman ..... F01K 23/10 60/772

FOREIGN PATENT DOCUMENTS

| | | | |
|---|---|---|---|
| CN | 103114881 | A | 5/2013 |
| CN | 103134070 | A | 6/2013 |
| JP | H09112292 | A | 4/1997 |
| RU | 2416729 | C2 | 4/2011 |
| WO | 2008118701 | A2 | 10/2008 |

OTHER PUBLICATIONS

Search Report for corresponding Chinese Appl. No. 201480052878.8 dated Jun. 14, 2017.
PCT International Search Report for corresponding PCT Application No. PCT/US2014/057005 dated Jan. 15, 2015.
PCT Written Opinion of the International Searching Authority for corresponding PCT Application No. PCT/US2014/057005 dated Dec. 9, 2014.

* cited by examiner

HEAT EXCHANGING SYSTEM AND METHOD FOR A HEAT RECOVERY STEAM GENERATOR

RELATED APPLICATIONS

This application is related to and claims priority to U.S. Provisional Application No. 61/882,991 filed on Sep. 26, 2013, with named inventor Daniel B. Kloeckener, and International Application No. PCT/US2014/057005 filed Sep. 23, 2014, and published under International Publication No. WO 2015/048029 for "Heat Exchanging System and Method for a Heat Recovery Steam Generator" both of which are incorporated by reference herein.

BACKGROUND ART

Natural gas serves as the energy source for much of the currently generated electricity. To this end, the gas undergoes combustion in a gas turbine which powers an electrical generator. However, the products of combustion leave the gas turbine as an exhaust gas quite high in temperature. In other words, the exhaust gas represents an energy source itself. This energy is captured in a heat recovery steam generator ("HRSG") that produces superheated steam that powers another electrical generator.

Such exhaust gas includes carbon dioxide and water in the vapor phase, but also includes traces of sulfur in the form of sulfur dioxide and trioxide. Those sulfur compounds, if combined with water, produce sulfuric acid which is highly corrosive. As long as the temperatures of the heating surfaces remain above the acid dew point temperature of the exhaust gas, $SO_2$ and $SO_3$ pass through the HRSG without harmful effects. But if any surface drops to a temperature below the acid dew point temperature, sulfuric acid will condense on that surface and corrode it.

Dew point temperatures vary depending on the fuel that is consumed. For natural gas the temperature of the heating surfaces should not fall below about 140° F. For most fuel oils it should not fall below about 235° F.

Generally, an HRSG comprises a casing having an inlet and an outlet and a succession of heat exchangers—namely a superheater, an evaporator, and a feedwater heater arranged in that order within the casing between the inlet and outlet.

Such heat exchangers for an HRSG can have multiple banks of coils, the last of which in the direction of the gas flow can be a feedwater heater. Surfaces vulnerable to corrosion by sulphuric acid do exist on the feedwater heater. The feedwater heater receives condensate that is derived from low-pressure steam discharged by the steam turbine, and elevates the temperature of the water. Then the warmer water from the feedwater heater flows into one or more evaporators that convert it into saturated steam. That saturated steam flows on to the superheater which converts it into superheated steam. From the superheater, the superheated steam flows to the steam turbine.

In this process, by the time the hot gas reaches the feedwater heater at the back end of the HRSG, its temperature is quite low. However, that temperature should not be so low that acids condense on the heating surfaces of the feedwater heater.

Generally, in the above-discussed process, most HRSGs produce superheated steam at three pressure levels—low pressure (LP), intermediate pressure (IP) and high pressure (HP). Further, an HRSG can have what are termed an LP Evaporator, an HP Economizer, and an IP Economizer. The feedwater heater typically discharges some of the heated feedwater directly into an LP evaporator.

A feedwater heater, or preheater, in a steam generator extracts heat from low temperature gases to increase the temperature of the incoming condensate before it goes off to the LP evaporator, HP economizer, or IP economizer. Multiple methods have been used to increase the temperature of the condensate before it enters any part of the preheater tubes within the gas path (e.g., recirculation pump, external heat exchanger). These methods are used to prevent the exhaust gas temperature from dropping below the acid dew point and causing sulfuric acid corrosion.

Prior systems and methods have been limited in application because the feedwater temperature was not high enough to protect against dew point corrosion of all fuels. The movement of the heat transfer coils to the hotter regions provides for higher differentials in the heat exchanger.

In the present disclosure, an external water-to-water heat exchanger heats the lower temperature inlet condensate with the source of heat being hot water that is exiting the first stage of the feedwater heater. The condensate flow first enters the external heat exchanger. Thereafter preheated condensate leaves the external heat exchanger and enters the feedwater heater. Water energy exiting the preheater is used to preheat the incoming condensate. The present disclosure places a section of a preheater surface into a hotter section of the gas flow, upstream of the LP evaporator, to achieve the beneficial result of increasing source inlet temperature and directly increasing the outlet temperature of the preheated condensate exiting the external heat exchanger. This arrangement allows the use of an external heat exchanger in designs with higher dew points in the cold end. The present system and method can thus create a larger temperature differential in the external water-to-water heat exchanger. This larger temperature differential than present in the prior art, yields a higher outlet temperature and protects the HRSG from cold end condensation corrosion from fuels with higher acid dew points.

The foregoing and other features and advantages of the invention as well as presently preferred embodiments thereof will become more apparent from the reading of the following description in connection with the accompanying drawings.

BRIEF DESCRIPTION OF DRAWINGS

Corresponding reference numerals indicate corresponding parts throughout the several figures of the drawings.

BEST MODE FOR CARRYING OUT THE INVENTION

Figure 1:
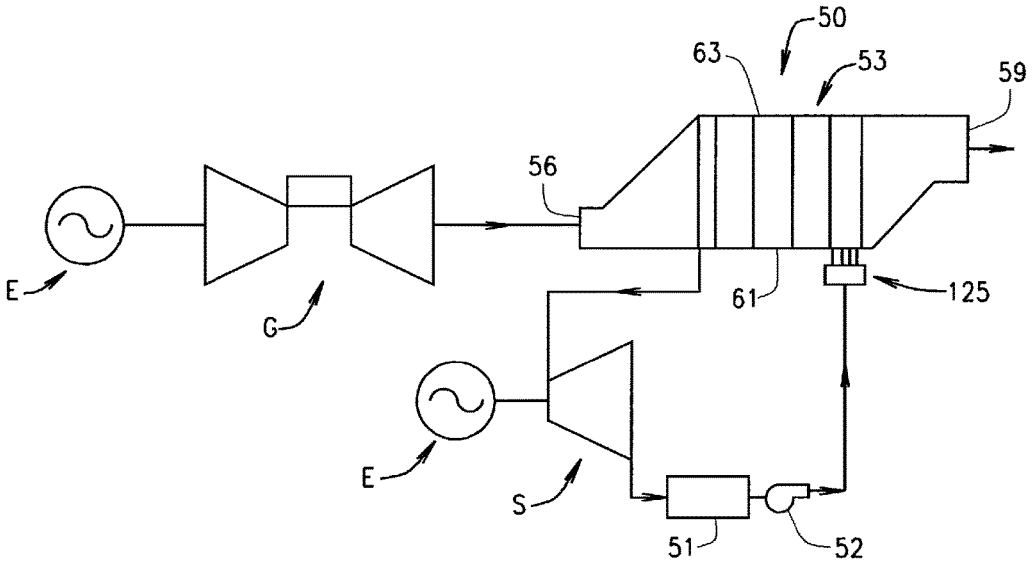
FIG. 1 is a schematic view of a power system that uses an heat recovery steam generator ("HRSG") provided with inventive features.

The following detailed description illustrates the claimed invention by way of example and not by way of limitation. The description clearly enables one skilled in the art to make and use the disclosure, describes several embodiments, adaptations, variations, alternatives, and uses of the disclosure, including what is presently believed to be the best mode of carrying out the claimed invention. Additionally, it is to be understood that the disclosure is not limited in its application to the details of construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting.

The inventive disclosures are now provided for a heat exchanging system and method for use in an HRSG. An overall illustration of a system which features use in a heat-recovery steam generator (HRSG) appears in U.S. Pat. No. 6,508,206 B1 (hereafter "'206 patent"). The '206 patent is hereby incorporated by reference in this application as if fully set forth herein. FIG. 1 of the present application shows a layout similar to that shown in FIG. 3 of the '206 patent. FIG. 1 hereof discloses a gas turbine G that discharges hot exhaust gases into an HRSG 50, which extracts heat from the gases to produce steam to power a steam turbine S. The gas turbine G and steam turbine S power the generators E that are capable of producing electrical energy. The steam turbine S discharges steam at a low temperature and pressure into a condenser 51 where it is condensed into liquid water. The condenser 51 is in flow connection with a condensate pump 52 that directs the water back to the HRSG 50 as feedwater.

The disclosure of the present inventive features of the present application show an HRSG 50 with an arrangement of heat exchangers and flow channels that provide improvements over the prior art.

Figure 2:
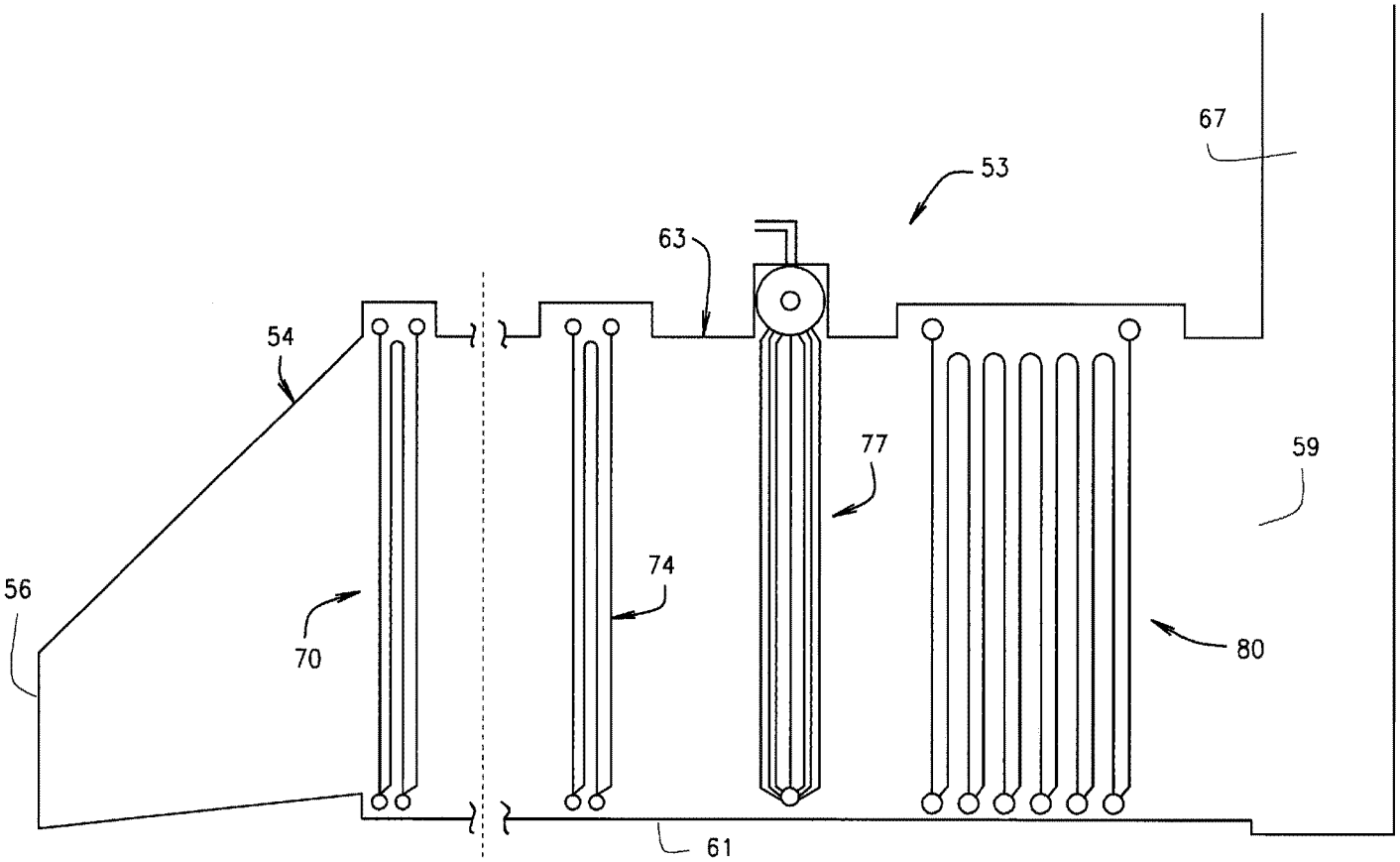
FIG. 2 is a sectional view of a novel HRSG.

With reference to FIGS. 1 and 2 of the present application, the HRSG 50 has a casing 53 within which are heat exchangers. Hot gases, such as discharged from a gas turbine, enter the casing 53 and pass through a duct 54 having an inlet 56 and an outlet 59. During that process, that gas passes through heat exchangers.

The casing 53 generally will have a floor 61 over which the heat exchangers are supported, and sidewalls that extend upwardly from the floor 61. Typically the top of the casing 53 is closed by a roof 63. The floor 61 and roof 63 extend between the sidewalls so that the floor 61, sidewalls and roof 63 help to form the duct 54. From outlet 59 the gas can flow through flu 67.

Generally, the heat exchangers comprise coils that have a multitude of tubes that usually are oriented vertically and arranged one after the other transversely across the interior of the casing 53. The coils are also arranged in rows located one after the other in the direction of the hot gas flow depicted by the arrows in FIG. 3 of the present application. The tubes contain water in whatever phase its coils are designed to accommodate. The length of the tubes can be as great as 80' tall.

Now attention is directed to the arrangement of the heat exchangers shown in FIG. 2. The general description for FIG. 2 will be given with an orientation of moving from the inlet 56 to the outlet 59, or from the left to the right looking at FIG. 2. Generally, reference character 70 represents what are termed "Upstream Coils" in an HRSG. For example, such Upstream Coils can include what are referred to in the '206 patent, as a superheater designated by reference character 16 in the '206 Patent that converts saturated steam to superheated steam; followed by at least one evaporator such as a high-pressure evaporator ("HP Evaporator") shown as 18 in the '206 patent; thence followed by a high-pressure economizer ("HP Economizer"). The HP Economizer is shown as a group of coils immediately to the right of the evaporator designated 18, and shown in FIG. 4 of the '206 patent. Hence the term "Upstream Coils 70" generally refer to all of the Superheater, HP Evaporator and HP Economizer. The amount of the space devoted to such components in the HRSG can depend upon the desired characteristics and performance of the HRSG 50.

Downstream from the Upstream Coils 70, the novel arrangement has a preheater booster 74. As will be discussed, the preheater booster 74 provides for a feedwater heater presence in a hotter region of the HRSG to facilitate return feeding therefrom to a heat exchanger that feeds water to other parts of the feedwater heater.

Continuing the description from upstream to downstream, left to right in FIG. 2, downstream from preheater booster 74 appears a low pressure evaporator 77 ("LP Evaporator"). Thence downstream from the LP Evaporator is what is generally designated a feedwater heater 80.

Figure 3:
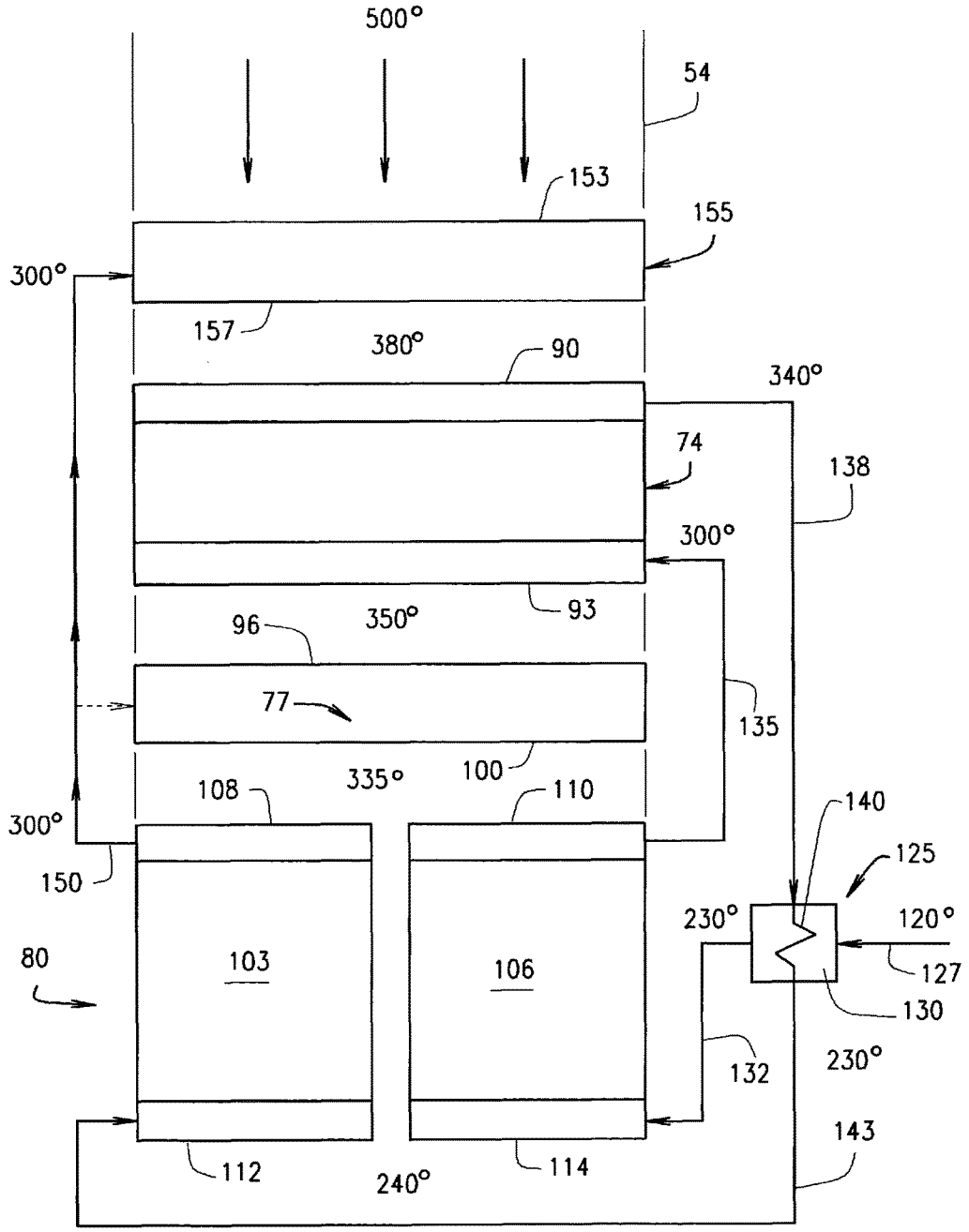
FIG. 3 is a schematic view of elements of a novel HRSG.

Now, with more specific reference to the schematic view of FIG. 3, the preheater booster 74 comprises a coil having an upstream face 90 and a downstream face 93. The exhaust gases flow into the upstream face 90 through the coil and thence through the downstream face 93 to leave the preheater booster 74.

As seen in the FIG. 3 schematic, the LP Evaporator 77 has an upstream face 96 and a downstream face 100. The exhaust gas leaves the preheater booster 74 thence flows into the LP Evaporator 77 front face 96, through the LP Evaporator 77, and through the LP Evaporator's downstream face 100 toward the feedwater heater 80.

The feedwater heater 80 has two sections 103 and 106, which can be arranged side by side in the duct 54, as shown in FIG. 3. Sections 103 and 106 each have an upstream face 108 and 110, respectively. The exhaust gases flow into the upstream faces 108 and 110, then through the coils of sections 103 and 106 respectively, thence exit through the downstream faces 112 and 114, respectively. From there, the exhaust gases can flow through outlet 59 and exit flu 67.

Focusing now on the flow of water among aforementioned components of the arrangement, a water-to-water heat exchanger 125 is illustrated as located to the exterior of the duct 54. The condensate pump 52 discharges feedwater into a supply pipe 127, which delivers that feed water into the inlet of the low temperature path 130 of heat exchanger 125. The feedwater leaves the low temperature path 130 in exchanger 125 at its outlet and flows into a connecting pipe 132 which acts as a conduit. Pipe 132 delivers the feedwater to the tubes at the downstream face 114 of section 106. The water leaves the section 106 at its upstream face 110 and flows through a transfer pipe 135 which serves as a conduit to connect with the inlet of the preheater booster 74 coil at its downstream face 93. The water flows thence through preheater booster coil 74 toward the upstream side thereof to exit the preheater booster coil 74 at its upstream face 90. From there, it flows into a transfer pipe 138 which acts as a conduit to connect with the inlet of the high temperature path 140 of heat exchanger 125.

Within the high temperature path 140 of heat exchanger 125 the temperature of the water decreases since it loses heat to water in the low temperature path 130. At the outlet of the high temperature path 140, the water enters transfer pipe 143 which acts as a conduit to be delivered to the section 103 at its downstream face 112. The water thence flows through section 103 to exit therefrom at its upstream face 108 whereby the temperature of the water is raised, to thence pass through a discharge pipe 150. Pipe 150 acts as a conduit and extends to connect with the LP Evaporator 77 at its downstream face 100. From the upstream face 96 of LP Evaporator 77, the water can flow, for example, to the HP Economizer.

Now the system will be discussed with exemplary temperatures. The exhaust gases from the gas turbine "G", enter the upstream face 153 of the last of the Upstream Coils 70, here designated, for example, as a high pressure (HP) economizer 155. The gases enter the HP Economizer upstream face 153 at a temperature of about 500° F. The exhaust gases exit the downstream face of HP Economizer 155 at a temperature of about 380° F., and enter the upstream face 90 of preheater booster 74 at about that same temperature.

FIG. 3 shows water leaving both of the upstream faces 108 and 110 of feedwater heater sections 103 and 106, respectively, at about 300° F. From the upstream face 110 of section 106, the water passes through pipe 135 to enter the downstream face 93 of preheater booster 74 at about 300° F. That fluid leaves the preheater booster upstream face 90 through pipe 138 at about 340° F. Through pipe 138, the water then flows into the high temperature path 140 of the heat exchanger 125 at about 340° F.

Water from the condensate pump 52 discharges water at about 120° F., which enters the heat exchanger 125 through pipe 127 at about the same temperature.

Now a review of the temperatures of the water flowing into and leaving the feedwater heater sections 103 and 106 is given. FIG. 3 shows that the water from the low temperature path of heat exchanger 125 feeds into the pipe 132 at about 230° F. From there, the water enters feedwater heater section 106 at its downstream face 114 at about 230° F. The water then passes through section 106 to exit at its upstream face 110 into pipe 135 at a temperature of about 300° F.

Turning now to the feedwater heater section 103, the temperature of water exiting the heat exchanger high temperature path 140 enters pipe 143 at about 230° F. From there it enters the downstream face 112 of section 103 at about 230° F.

Thus the water temperature entering both downstream faces 112 and 114 of sections 103 and 106 is about 230° F.

The water entering section 103 exits at its upstream face 108 at the temperature of about 300° F. to pass through pipe 150 into LP Evaporator 77 at that temperature. Pipe 150 can also have a branches feeding off of it at 300° F. to the downstream face 157 of HP Economizer 155. Additionally, depending on the arrangement of coils of a particular HRSG, water feeding off the upstream face 108 of section 103 can also flow at 300° F. to the downstream face of other coils located upstream of preheater booster 74, such as to the downstream face of an intermediate pressure (IP) Economizer.

The temperature of the hot gas exiting the downstream face 100 of LP Evaporator 77 and entering at the upstream faces 108 and 110 of feedwater heater sections 103 and 106 is about 335° F. The temperature of the hot gas exiting the feedwater heater sections 103 and 106, at their respective downstream faces 112 and 114, is about 240° F.

Thus the surfaces of the tubes making up feedwater heater sections 103 and 106 are maintained to be about 240° F. or higher. This temperature is higher than the aforementioned dew point for condensation of sulphuric acid. Thus the condensation of sulfuric acid on the surfaces of the tubes making up the sections 103 and 106 will be resisted with the present design.

The gases leave the downstream preheater booster face 93 at a temperature of about 350° F., and enter the upstream face 96 of the LP Evaporator 77 at about that 350° F. temperature. The gases exit the LP Evaporator downstream face 100 at a temperature of about 335° F.

Feedwater from the condenser 51 can be discharged at approximately 120° F. through the supply pipe 127 into the low temperature path 130 of the heat exchanger 125.

The water leaving the heat exchanger 125 through the high temperature path exits at 230° F. and flows into section 103 at its downstream face 112 at a temperature of about 230° F.

With the present design the heat exchanger designated 125 does not require recirculation, and thus a recirculation pump and its attendant overhead and expense is not required for the heat exchanger. Further, with the present design there is no need to bypass any section of feedwater heater 80.

Also, with the present arrangement, the water temperature feeding into the LP Evaporator 77 from the feedwater preheater 80 enters at a temperature of 300° F. as compared to 250° F. with a temperature of water feeding into an LP Evaporator of a prior art system. Moreover, in the present system, water temperature of 300° F. feeding from the feedwater heater section 103 to the HP Economizer 155 or other economizer located upstream of the LP Evaporator, compares favorably to the water input temperature of 250° F. to HP Economizers and/or IP Economizers in a prior art design.

Figure 4:
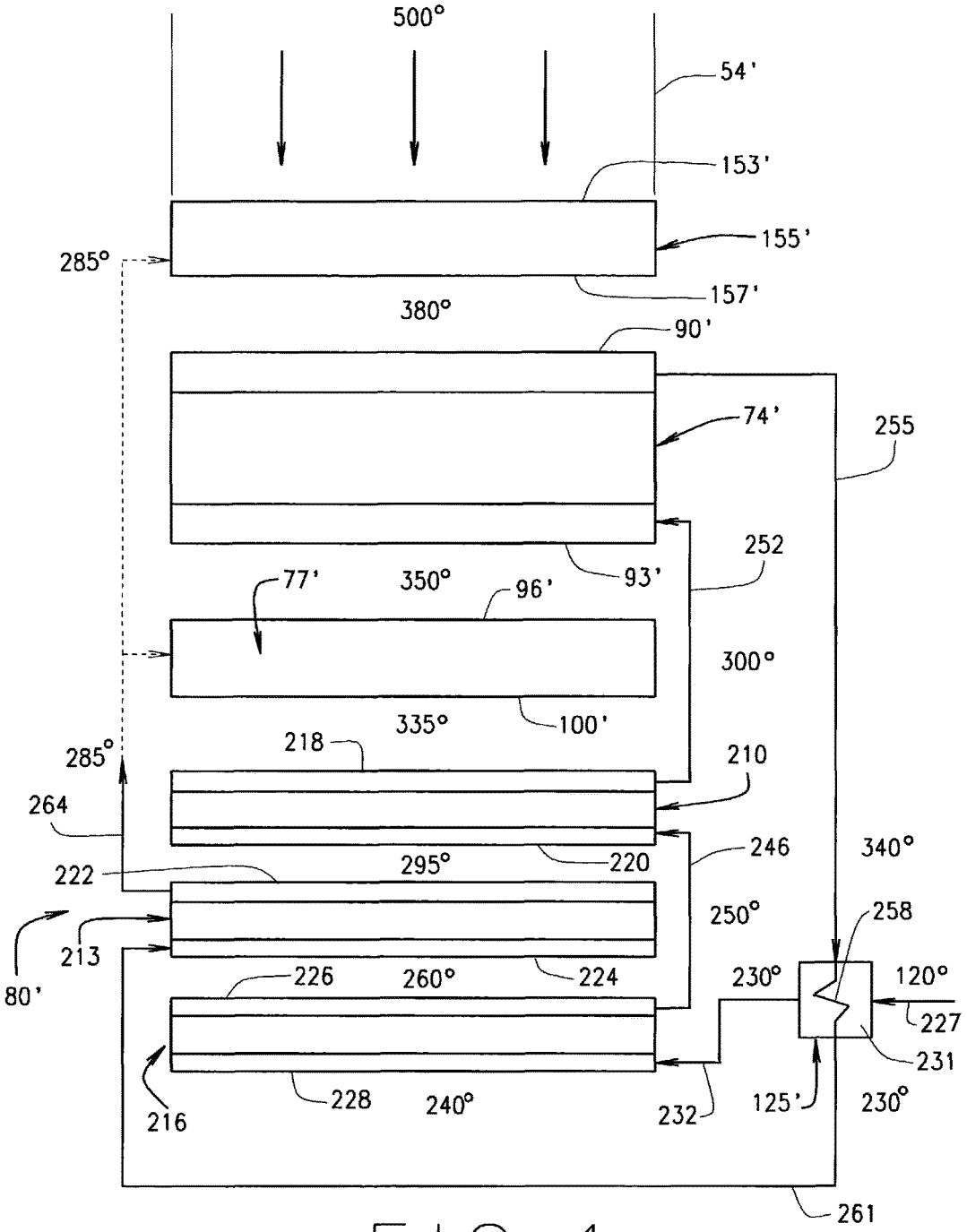
FIG. 4 is a schematic view of elements of another embodiment of the novel HRSG.

Now attention is directed to the modification of FIG. 4. FIG. 4 can include some of the same elements as FIG. 3. FIG. 4 shows HRSG hot gas flow in a direction from the inlet, indicated by arrows, through the upstream face 153' of an HP Economizer 155', through HP Economizer 155' and its downstream face 157', as described for FIG. 3. Thence the hot gas flows to the upstream face 90' of a preheater booster 74', though booster 74' and its downstream face 93' toward and thorough the front face 96' of LP Evaporator 77'. The hot gas passes through the coil of LP Evaporator 77' and through its downstream face 100'.

Instead of the two feed water heater sections 103 and 106 described regarding FIG. 3 which are placed generally side by side, the feed water heater 80' of FIG. 4 has its sections containing coils arranged from front to rear, or upstream toward downstream, in series fashion. Feedwater heater 80' has a section 210 which is located farthest upstream of the three sections, with a second intermediate section 213 positioned downstream there from. Then downstream from second section 213 is the farthest downstream section, i.e., the third section 216. Each of sections 210, 213 and 216 have pairs of corresponding upstream faces and downstream faces 218 and 220, 222 and 224, and 226 and 228, respectively.

In FIG. 4, a water to water heat exchanger 125' located exterior of duct 54', is similar to the exchanger 125 of FIG. 3. In FIG. 4, condensate pump 52 discharges feedwater though a supply pipe 227 into the low temperature path 231 of the heat exchanger 125'. The feedwater leaves the low temperature path 231 of exchanger 125' to flow into connecting pipe 232.

Pipe 232 delivers the feedwater to the downstream face 228 of feedwater heater section 216. The water leaves section 216 at its upstream face 226 to flow through a transfer pipe 246 to connect with the inlet of section 210 at its downstream face 220. The water flows through the coil of section 210 to thence leave its upstream face 218 to flow into a transfer pipe 252. From pipe 252, the water flows to preheater booster 74' at its downstream face 93'. The water then passes through preheater heater booster 74' to exit preheater booster stream face 90' into a transfer pipe 255.

Thence the water flows through pipe 255 to connect with the inlet of the high temperature path 258 of heat exchanger 125'.

Within the high temperature path 258 of heat exchanger 125', the temperature of the water decreases since it loses heat to water in the low temperature path 231. At the outlet of the high temperature path 258, the water enters transfer pipe 261 to feed into feedwater heater section 213 at its downstream face 224. The water flows through section 213 to exit therefrom at its upstream face 222, whereby the temperature of the water is raised, to then pass into a discharge pipe 264. Pipe 264 extends to connect with LP Evaporator 77' at its downstream face 100', to be heated therein. From the LP Evaporator 77', the water can flow from its upstream face 96', to the HP Economizer, for example.

Now, as with the FIG. 3 embodiment, the FIG. 4 embodiment will be discussed with exemplary temperatures. Description of the hot gas airflow through the HP Economizer 155' and through preheater booster 74' is similar to that described for FIG. 3 with the various pipes described acting as conduits. Exhaust gases from gas turbine "G", enter the upstream face 153' of the last of the Upstream Coils, here designated, for example, as HP Economizer 155. The gases enter the HP Economizer upstream face 153' at a temperature of about 500° F. Then the exhaust gases exit the HP Economizer face 157' at about 380° F., to next enter the upstream face 90' of preheater booster 74' at about that same temperature, and pass through booster 74' and its downstream face 93' at about 350° F. The hot gas then flows at about 350° F. through LP Evaporator 77' and exits its downstream face 100' at about 335° F.

Turning now to the most upstream of the feedwater heater sections, water leaves upstream face 218 of section 210, at a temperature of about 300° F. Then the water passes through pipe 252 to enter the downstream face 93' of preheater booster 74' at about 300° F. That water then passes through preheater booster 74' to its upstream face 90', to next exit through pipe 255 at about 340° F. The water then flows through pipe 255 into the high temperature path 258 of heat exchanger 125' at a temperature of about 340° F.

Water from the condensate pump 52 discharges water at about 120° F. into the heat exchanger 125' through pipe 227 at about that same temperature. Now a review of the temperatures of the water as it leaves the heat exchanger 125' is given. The water from the low temperature path 231 of heat exchanger 125' feeds into the pipe 232 at a temperature of about 230° F. From there, the water at about 230° F. enters the most downstream of the feedwater heater sections, section 216, at its downstream face 228. The water then passes through section 216 to enter its upstream face 226 into discharge pipe 246 at about 250° F. Through pipe 246 the water then enters feedwater section 210 at its downstream face 220 at about 250° F. The water then flows through section 210 and exits at its upstream face 218 through pipe 252 at a temperature of about 300° F.

The water exits heat exchanger 125' through its high temperature path 258 to enter pipe 261 at a temperature of about 230° F. The water flows through pipe 261 to enter the downstream face 224 of feedwater heater section 213 at about 230° F. The water exits section 213 at its upstream face 222 at a temperature of about 285° F. to pass through pipe 264 into LP Evaporator 77' at that temperature. Pipe 285 can also have a branch feeding off of it at 285° F. to the downstream face 157' of HP Economizer 155'.

Further, depending upon the arrangement of coils of a particular HRSG, water feeding off the upstream face 222 of section 213 can also flow at 285° F. to the downstream face of other coils located upstream of preheater booster 74', such as to the downstream face of an intermediate pressure (IP) economizer.

The temperature of the hot gas exiting the downstream face 100' of LP Evaporator 77' and entering at the upstream face 218 of feedwater heater section 210, is at about 335° F. The temperature of the hot gas exiting the feedwater heater section 210 at its downstream face 220 is about 295° F. The temperature of the hot gas exiting feedwater heater section 213 at its downstream face 224 is about 260° F. Finally, at the downstream face 228 of the farthest downstream feedwater section 216, the hot gas exits at about 240° F. Hence with the FIG. 4 embodiment, the surfaces of the tubes making up feedwater heater sections 210, 213 and 216 are maintained to be about 240° F. or higher. This temperature, as with FIG. 3 embodiment, is higher than the aforementioned dew point for condensation of sulphuric acid. Hence, the FIG. 4 embodiment resists the condensation of sulphuric acid on the surfaces of the tubes making up the section 210, 213 and 216.

As for the FIG. 3 embodiment, with the FIG. 4 embodiment, the heat exchanger 125' does not require recirculation, or a recirculation pump with its attendant overhead and expense. Also, as with FIG. 3 embodiment, the FIG. 4 embodiment does not require a bypass of any section of the feedwater heater 80'.

Further, with the present arrangement, the water temperature feeding into the LP Evaporator 77' from the feedwater preheater 80' enters at a temperature of 285° F. as compared to 250° F. for the temperature of water feeding into an LP Evaporator of a prior art system. Moreover, with the FIG. 4 embodiment, water temperature of 285° F. feeding from feedwater heater section 213 to the HP Economizer 155' or other economizer located upstream of the LP Evaporator, compares favorably to the water input temperature 250° F. to HP Economizers and/or IP Economizers in a prior art design.

Figure 5:
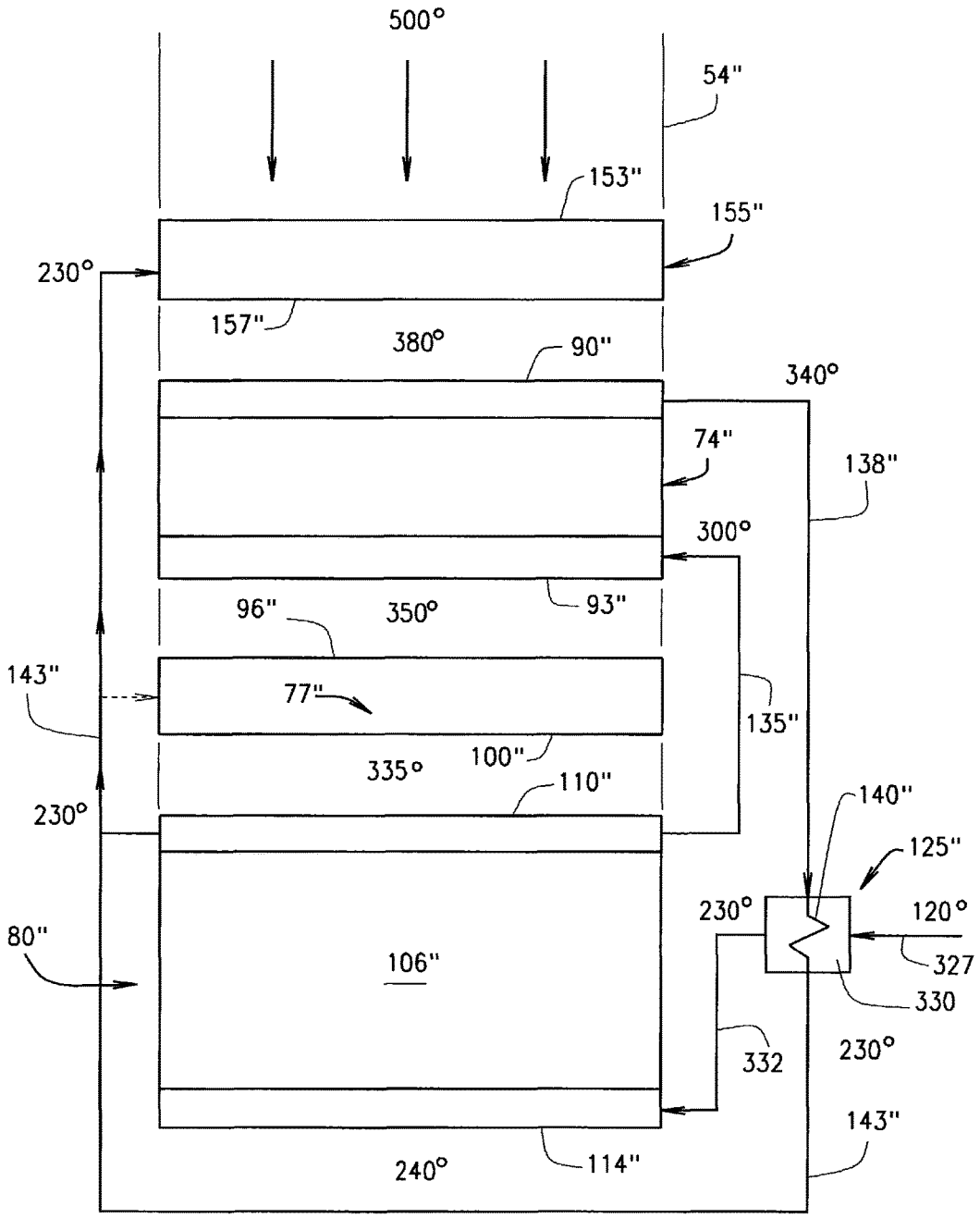
FIG. 5 is a schematic view of elements of another embodiment of the HRSG.

FIG. 5 shows another embodiment that is less preferable than that of FIG. 3 and FIG. 4. In FIG. 5 the feedwater heater 80" comprises a single segment 106", rather than the two-section feedwater heater 80 such as illustrated in FIG. 3, or the three-section feedwater heater 80' shown in FIG. 4. In FIG. 5, the water to water heat exchanger 125", like the exchangers 125' and 125", has a high temperature path 140" through which water exits into pipe 143". Pipe 143", rather than extending to feed into the feedwater heater, extends to connect to feed into LP Evaporator 77" or into the HP Economizer 355, or to a heat exchanger coil upstream of HP Economizer 355.

In FIG. 5, the various pipes shown and described act as conduit for water flow. In FIG. 5 the water from the low temperature path 330 of water-to-water heat exchanger 125" exits exchanger 125" to feed into the pipe 332 at a temperature of about 230° F. From there the water, at about 230° F., enters near the downstream surface 114" of feed water heater 80". The water then passes through the feed water heater 80" to enter its upstream face 110" and then to exit at the upstream face 110" through pipe 135" at a temperature of about 300° F.

From the upstream face 110" of the feed water heater 80", the water passes through pipe 135" to enter the downstream face 93" of preheater booster 74" at about 300° F. That fluid leaves the preheater booster upstream face 90" through pipe 138" at about 340° F. Through pipe 138", the water then flows into the high temperature path 140" of heat exchanger 125" at about 140° F.

Other designs employing the inventive features can be embodied with feedwater heaters having more than three sections such as in FIG. 4's arrangement. For example four or five sections can be arrange in a fashion of being space from each other transversely as sections 103 and 16 are in FIG. 3, or spaced longitudinally as the sections 210, 213 and 216 are in FIG. 4.

Further, the embodiments have been illustrated with the entry of the water into the various heat exchangers being preferably at the downstream faces of the sections. However, less preferably the water could enter father upstream in the heat exchanger. Likewise the water is shown preferably as exiting various heat exchangers at a point at the upstream face of the heat exchanger, while less preferably the water could enter farther downstream from the upstream face.

The preheater booster coils versions 80, 80' and 80' have been illustrated in FIGS. 3, 4 and 5 as preferably being downstream of the HP Economizers 155, 155' and 155", respectively. Such location of the preheater booster in FIGS. 3, 4 and 5 relative to the LP Evaporator and HP Economizer is believed to be the preferred and most efficient location for the preheater booster. The system is more efficient if the heat exchanger coils are positioned to remove heat from exhaust gas where the gas temperature surrounding the coils is closer to the water temperature inside the coils. If the preheater booster were located farther upstream to be upstream of the HP Economizer, the preheater booster would be removing energy from gas which energy would thence be unavailable to be removed by coils downstream from the preheater booster in such location. Therefore, to so locate the preheater booster coils would take away energy from other potential upstream higher temperature coils that would be thence downstream of the preheater booster, which coils need the energy for heating the water or steam.

However, the preheater booster coils can also be located upstream of the HP Economizer and provide higher temperature water to the infeed of the water to water heat exchangers such as illustrated at 125, 125' and 125". In such a case, the differential of the temperature of the gas surrounding the preheater booster coils to the water temperature inside the preheater booster coils would be higher than for the systems specifically illustrated in FIGS. 3, 4 and 5. Thus such a system would be less efficient in view of the above comment that the system is more efficient if the heat exchanger coils are positioned to remove heat from exhaust gas where the gas temperature surrounding the coils is closer to the water temperature inside the coils. Nevertheless, with such a location the temperature of the water leaving the preheater booster coils to be fed through pipes such as 138, 138' and 138" into the water to water heat exchangers such as illustrated at 125, 125' and 125", would be sufficiently high to keep the surface temperature of the coils of the corresponding feedwater heater above the aforementioned dew point of sulphuric acid.

The connections of the various discussed pipes have been described as preferably at the downstream or upstream faces of the heat exchangers such as the feedwater heater sections, the preheater booster, the LP Evaporator and the HP Economizer. However less preferably the connections of the various pipes can be otherwise near the downstream face or upstream face of such components.

Changes can be made in the above constructions without departing from the scope of the disclosure, it is intended that all matter contained in the above description or shown in the accompanying drawings shall be interpreted as illustrative and not in a limiting sense.

The invention claimed is:

1. A heat recovery steam generator comprising:

a casing having an inlet and an outlet and a gas flow path there between for gas flow upstream from the inlet toward the outlet downstream therefrom;

low pressure evaporator coils of heat exchanger tubes, the low pressure evaporator coils located within the casing downstream from the inlet;

preheater booster coils of heat exchanger tubes, the preheater booster coils located within the casing downstream from the casing inlet and upstream of the low pressure evaporator coils, so that gas passing through the inlet can flow downstream to pass through the preheater booster coils, and gas passing through the preheater booster coils can flow downstream therefrom;

feedwater heater coils of heat exchanger tubes, the feedwater heater coils located within the casing downstream from the low pressure evaporator coils so that gas passing through the low pressure evaporator coils can flow downstream from the low pressure evaporator coils to pass through the feedwater heater coils;

a water to water heat exchanger having a low temperature path and a higher temperature path;

a first conduit extending from flow connection with the preheater booster coils to flow connection with the high temperature path of the water to water heat exchanger, the first conduit configured for water to flow there through from the preheater booster coils to the water to water heat exchanger; and a second conduit extending from the feedwater heater coils to the preheater booster coils of heat exchanger tubes, the second conduit configured to allow water to flow there through from the feedwater heater coils to the preheater booster coils.

2. The heat recovery steam generator of claim 1, wherein the preheater booster coils have an upstream face, and the first conduit exits the preheater booster coils near the upstream face of the preheater booster coils.

3. The heat recovery steam generator of claim 1, wherein the preheater booster coils have a downstream face, and the feedwater heater coils have an upstream face, and the second conduit exits the feedwater heater coils near the upstream face of the feedwater heater coils to extend to flow connection with the preheater booster coils near the downstream face of the preheater booster coils.

4. The heat recovery steam generator of claim 3, further comprising a low pressure evaporator conduit configured to extend for flow connection from the feedwater heater coils to the low pressure evaporator coils of heat exchanger tubes.

5. The heat recovery steam generator of claim 3, further comprising a third conduit configured to extend for flow connection from the water-to-water heat exchanger to be in flow connection with the feedwater heater coils to allow flow from the water to water heat exchanger to the feedwater heater coils.

6. The heat recovery steam generator of claim 1, further comprising high pressure economizer coils of heat exchanger tubes located upstream of the preheater booster coils, and a high pressure economizer conduit configured to extend for flow connection from the feedwater heater coils to the high pressure economizer coils of heat exchanger tubes.

7. The heat recovery steam generator of claim 6, further comprising additional upstream coils of heat exchanger tubes, the additional upstream coils located within the casing upstream of the high pressure economizer coils and downstream from the casing inlet so that gas coming from the inlet can flow downstream through the additional upstream coils and thereafter flow through the high pressure economizer coils.

8. The heat recovery steam generator of claim 1 wherein the feedwater heater coils comprise a first section and a second section, and wherein the second conduit extends from the first feedwater heater section to the preheater booster coils.

9. The heat recovery steam generator of claim 8, further comprising the first feedwater heater section having an upstream face and a downstream face, and wherein the second conduit extends for flow connection from near the upstream face of the first section to flow connection with the preheater booster coils, and further comprising a third conduit extending from flow connection with the water to water heat exchanger to flow connection near the downstream face of the first feedwater heater section.

10. The heat recovery steam generator of claim 2, further comprising the feedwater heater having a first section, second section and third section, and wherein:

the first feedwater heater section has an upstream face and a downstream face, and the preheater booster coils have a downstream face, and wherein the second conduit flows from near the upstream face of the first feedwater heater section to near the downstream face of the preheater booster coils, the second feedwater heater section has an upstream face and a downstream face, and a third conduit extending from flow connection to the water to water heat exchanger to flow connection near the downstream face of the second feedwater heater section, the third conduit configured for water to flow there through from the water to water heat exchanger to the second feedwater heater section; and said third feedwater heater section has an upstream face and a downstream face, and wherein a fourth conduit extends from near the upstream face of the third feedwater heater section to near the downstream face of the first feedwater heater section, the fourth conduit configured for water to flow there through from the third feedwater heater section to the first feedwater heater section.

11. The heat recovery steam generator of claim 10 further comprising an evaporator-economizer conduit flowing from near the upstream face of the second section of the feedwater heater to connection with one of the low pressure evaporator coils or high pressure economizer coils.

12. The heat recovery steam generator of claim 10, further comprising the first feedwater heater section being upstream of the second feedwater heater section, and the second feedwater heater section being upstream of the third feedwater heater section.

13. The heat recovery steam generator of claim 12, further comprising a fifth conduit configured to extend for flow connection from the water-to-water heat exchanger to near the downstream face of the third feedwater heater section to be in flow connection with the feedwater heater coils of the third feedwater heater section to allow flow from the water to water heat exchanger to the feedwater heater coils of the third feedwater heater section.

14. The heat recovery steam generator of claim 13, further comprising a sixth conduit configured to extend for flow connection from near the upstream face of the second feedwater heater section to flow connection with one of the low pressure evaporator coils or high pressure economizer coils.

15. A heat recovery steam generator comprising:

a casing having an inlet and an outlet and a gas flow path there between for gas flow upstream from the inlet toward the outlet downstream therefrom;

low pressure evaporator coils of heat exchanger tubes, the low pressure evaporator coils located within the casing downstream from the upstream coils;

preheater booster coils of heat exchanger tubes, the preheater booster coils having an upstream face and a downstream face, the preheater booster coils located within the casing downstream from the casing inlet and upstream of the low pressure evaporator coils, so that gas passing through the inlet can flow downstream to pass through the front face of the preheater booster coils and through the preheater booster coils to exit the downstream face of the preheater booster coils and flow downstream therefrom;

feedwater heater coils of heat exchanger tubes, the feedwater heater coils comprising a first section and a second section which sections are located within the casing downstream from the low pressure evaporator coils so that gas passing through the low pressure evaporator coils can flow downstream from the low pressure evaporator coils to pass through the feedwater heater coils;

a water to water heat exchanger having a low temperature path and a higher temperature path;

a first conduit extending from flow connection near the upstream face of the preheater booster coils to flow connection with the high temperature path of the water to water heat exchanger, the first conduit configured for water to flow there through from the preheater booster coils to the high temperature path of water to water heat exchanger;

a second conduit extending from near the upstream face of the first feedwater heater section heater coils to near the downstream face of the preheater booster coils, the second conduit configured to allow water to flow there through from the first feedwater heater section coils to the preheater booster coils;

a third conduit configured to extend for flow connection from the water-to-water heat exchanger to near the downstream face of the first feedwater heater section to be in flow connection with the feedwater heater coils to allow flow from the water to water heat exchanger to the feedwater heater coils; and a fourth conduit configured to extend for flow connection with the water to water heat exchanger to near the downstream face of the second feedwater heater section to allow flow from the water to water heat exchanger to the second feedwater heater section.

16. The heat recovery steam generator of claim 15, further comprising an evaporator-economizer conduit configured to extend for flow connection from near the upstream face of the second section of the feedwater heater to connection with one of the low pressure evaporator coils or high pressure economizer coils.

17. The heat recovery steam generator of claim 16, further comprising additional upstream coils of heat exchanger tubes, the additional upstream coils located within the casing upstream of the high pressure economizer coils and downstream from the casing inlet so that gas coming from the inlet can flow downstream through the additional upstream coils and thereafter flow through the high pressure economizer coils.

18. The heat recovery steam generator of claim 16, further comprising additional upstream coils of heat exchanger tubes, the additional upstream coils located within the casing upstream of the high pressure economizer coils and downstream from the casing inlet so that gas coming from the inlet can flow downstream through the additional upstream coils and thereafter flow through the high pressure economizer coils.

19. A process for heating feedwater for a heat recovery steam generator (HRSG) which HRSG has:

a casing having an inlet and an outlet and an internal gas exhaust flow path there between, comprising:

a water-to-water heat exchanger positioned to be external to the internal gas exhaust flow path of the HRSG, the external water-to-water heat exchanger having a low temperature path and a higher temperature path;

low pressure evaporator coils of heat exchanger tubes, the low pressure evaporator coils located within the casing downstream from the inlet;

preheater booster coils of heat exchanger tubes, the preheater booster coils located within the casing downstream from the casing inlet and upstream of the low pressure evaporator coils, so that gas passing through the inlet can flow downstream to pass through the preheater booster coils, and gas passing through the preheater booster coils can flow downstream therefrom;

feedwater heater coils of heat exchanger tubes, the feedwater heater coils located within the casing downstream from the low pressure evaporator coils so that gas passing through the low pressure evaporator coils can flow downstream from the low pressure evaporator coils to pass through the feedwater heater coils;

a first conduit extending from flow connection with the preheater booster coils to flow connection with the high temperature path of the water to water heat exchanger; and a second conduit extending from the feedwater heater coils to the preheater booster coils of heat exchanger tubes;

the process comprising the steps of:

directing water to flow through the first conduit from the preheater booster coils to the higher temperature path of the water to water heat exchanger; and directing water to flow through the second conduit from the feedwater heater coils to the preheater booster coils of heat exchanger tubes.

20. The process of claim 19, wherein the preheater booster coils have an upstream face, and a downstream face, and the feedwater heater coils have an upstream face; a third conduit extending from the water-to-water heat exchanger to the feedwater heater coils;

further comprising the steps of:

directing water to exit the preheater booster coils through the first conduit near the upstream face of the preheater booster coils to flow into the higher temperature path of the water to water heat exchanger;

directing water from the feedwater heater coils near the upstream face of the feedwater heater coils through the second conduit to flow into connection with the preheater booster coils near the downstream face of the preheater booster coils; and directing water to flow through the third conduit from the water-to-water heat exchanger to the feedwater heater coils.

21. The process of claim 20, wherein the HRSG has an evaporator-economizer conduit extending from the feedwater heater coils to the low pressure evaporator coils of heat exchanger tubes; and high pressure economizer coils of heat exchanger tubes located upstream of the preheater booster coils and a conduit extending from the feedwater heating coils to the high pressure economizer coils;

further comprising the steps of:

directing water from the feedwater heater coils to flow to one of the low pressure evaporator coils or the high pressure economizer coils.

22. The process of claim 19, wherein the feedwater heater coils comprise a first section and a second section, the first feedwater heater-section having an upstream face and a downstream face, wherein the second conduit extends for flow connection from near the upstream face of the first feedwater heater section to flow connection with the preheater booster coils, and a third conduit extending from flow connection with the water to water heat exchanger to flow connection near the downstream face of the first feedwater heater section;

further comprising the steps of:

directing water through the second conduit from near the upstream face of the first feedwater heater section to flow into the preheater booster coils; and directing water through the third conduit from the water to water heat exchanger to flow into to the first feedwater heater section near the downstream face of the first feedwater heater section.

23. The process of claim 22, wherein the preheater booster coils have an upstream face, and a downstream face;

further comprising the steps of:

directing water through the first conduit to flow from near the upstream face of the preheater booster coils to the higher temperature path of the water to water heat exchanger.

24. The process of claim 23, wherein the second feedwater heater section has a downstream face, and including a fourth conduit extending from the water to water heat exchanger to near the downstream face of the second feedwater heater section;

further comprising the step of directing water to flow from the water to water heat exchanger into the second feedwater heater section near the downstream face of the second feedwater heater section.

25. The process of claim 24, wherein the second section of the feedwater heater has an upstream face, and including an evaporator-economizer conduit extending for flow connection from near the upstream face of the second section of the feedwater heater to connection with one of the low pressure evaporator coils or high pressure economizer coils;

further comprising the step of directing water from near the upstream face of the second section of the feedwater heater to one of the low pressure evaporator coils or high pressure economizer coils.

26. The process of claim 19 wherein the feedwater heater has a first section, second section and third section, and wherein:

the first feedwater heater section has an upstream face and a downstream face and the second conduit flows from near the upstream face of the first feedwater heater section to near the downstream face of the preheater booster coils, the second feedwater heater section has an upstream face and a downstream face, and a third conduit extends from the water to water heat exchanger to connection near the downstream face of the second feedwater heater section; and the third feedwater heater section has an upstream face and a downstream face, and a fourth conduit extends from near the upstream face of the third feedwater heater section to near the downstream face of the first feedwater heater section;

further comprising the steps of:

directing water to flow from near the upstream face of the first feedwater heater section to near the downstream face of the preheater booster coils, directing water to flow from the water to water heat exchanger to near the downstream face of the second feedwater heater section; and directing water to flow from near the upstream face of the third feedwater heater section to near the downstream face of the first feedwater heater section.

27. The process of claim 26, wherein the first feedwater heater section is upstream of the second feedwater heater section, and the second feedwater heater section is upstream of the third feedwater heater section; a fifth conduit extending from the water-to-water heat exchanger to connect near the downstream face of the third feedwater heater section;

further comprising the steps of:

directing water to flow from the water to water heat exchanger to the third feedwater heater section near the downstream face of the third feedwater heater section.

28. The process of claim 27, wherein there is a sixth conduit extending for flow connection from near the upstream face of the second feedwater heater section to one of the low pressure evaporator coils or high pressure economizer coils;

further comprising the step of directing water to flow from near the upstream face of the second section of the feedwater heater to one of the low pressure evaporator coils or high pressure economizer coils.

29. The process of claim 20, wherein the temperature of the feedwater entering the low temperature path of the water-to-water heat exchanger initially has a temperature below that of the dew point of sulfuric acid in the exhaust gas, and the feedwater from the third conduit flowing from the water-to-water heat exchanger to the feedwater heater coils enters the feedwater heater coils at a temperature at or above 230° F.

30. The process of claim 24, wherein the temperature of the feedwater entering the low temperature path of the water-to-water heat exchanger initially has a temperature below that of the dew point of sulfuric acid in the exhaust gas, the feedwater from the third conduit flowing from the external water-to-water heat exchanger to the first feedwater heater section enters the inlet of the first feedwater heater section at a temperature at or above 230° F., and the feedwater from the fourth conduit flowing from the water-to-water heat exchanger to the second feedwater heater section enters the second feedwater heater section at a temperature at or above 230° F.

31. The process of claim 27, wherein the temperature of the feedwater entering the low temperature path of the water-to-water heat exchanger initially has a temperature below that of the dew point of sulfuric acid in the exhaust gas, the feedwater from the fifth conduit flowing from the water-to-water heat exchanger to the third feedwater heater section enters the third feedwater heater section at a temperature at or above 230° F., and the feedwater from the third conduit flowing from the water-to-water heat exchanger to the second feedwater heater section enters the second feedwater heater section at a temperature at or above 230° F.

* * * * *